United States Patent [19]

Morikawa et al.

[11] 3,950,929

[45] Apr. 20, 1976

[54] METHOD OF FEEDING A SLIVER INTO A COMBING SECTION OF AN OPEN END SPINNING MACHINE AND A PRESSER THEREFOR

[75] Inventors: Takashi Morikawa, Amagasaki; Hidetoshi Kihara, Hirakata; Tooru Urifu, Itami; Hisateru Takahashi, Fukui, all of Japan

[73] Assignees: Daiwa Boseki Kabushiki Kaisha, Minamiyutaro; Kabushiki Kaisha Toyoda Jidoshokki Seisakusho, Kariya, both of Japan

[22] Filed: Oct. 8, 1974

[21] Appl. No.: 513,164

[30] Foreign Application Priority Data

Oct. 17, 1973 Japan ..... 48-117134

[52] U.S. Cl. ..... 57/58.95; 57/156

[51] Int. Cl.[2] ..... D01H 1/12; D01H 7/00

[58] Field of Search ..... 57/58.89–58.95, 106, 156

[56] References Cited

UNITED STATES PATENTS

| | | | |
|---|---|---|---|
| 3,335,558 | 8/1967 | Doublebsky et al. | 57/58.95 |
| 3,696,604 | 10/1972 | Kaisha et al. | 57/58.95 |
| 3,762,144 | 10/1973 | Didek et al. | 57/58.95 X |
| 3,762,146 | 10/1973 | Landwehrkemp | 57/58.95 |
| 3,775,956 | 12/1973 | Rajnoha et al. | 57/58.91 |
| 3,826,071 | 7/1974 | Grau | 57/58.95 X |

*Primary Examiner*—Donald E. Watkins
*Attorney, Agent, or Firm*—Wenderoth, Lind & Ponack

[57] ABSTRACT

A method and apparatus of feeding a sliver into a combing section in an open end spinning machine including a feed roller and a combing roller which are arranged side by side on parallel axes within a main body. A pressed sliver is released from the peripherial surface of the feed roller and is guided by the nip surface of a presser which has a curved portion of a radius which is a little larger than that of the feed roller and a flat fiber guide surface extending from the nip surface toward the combing roller substantially linearily relative to the nip surface to guide the sliver fed out from the feed roller to the combing roller. Guide walls are provided extending along the fiber guide surface for limiting the spreading of the fiber bundle passing along the guide surface. The guide surface of the presser is oriented to transfer the fibers to a raking point substantially at a point of contact between the combing roller and a tangent common to the feed roller and the combing roller and lying on the same side of the parallel axes of these rollers. The guide surface is at an angle of from 0° to 15° with said common tangent taken as the reference line.

2 Claims, 6 Drawing Figures

METHOD OF FEEDING A SLIVER INTO A COMBING SECTION OF AN OPEN END SPINNING MACHINE AND A PRESSER THEREFOR

The present invention relates to a method of feeding a sliver into a combing section of an open end spinning machine.

The present invention further relates also to an improved presser which is suitable for use in working the method according to the present invention.

An open end spinning machine is known in which a feed roller and a combing roller are arranged side by side on parallel axes within a main body and a sliver is delivered by the rotation of the feed roller while being held between the nip surface of a presser and the feed roller, whereupon it is raked and combed by a saw-tooth wire on the combing roller and then transferred to a rotary spinning chamber through a channel.

The combing section of the conventional open end spinning machine described above causes substantially no trouble to particular fibers such as cotton, or artificial or synthetic fibers having staple lengths nearly equal to that of cotton and provides the desired combing effect. For artificial or synthetic fibers having considerably longer staple lengths than that of cotton, however, it does not necessarily provide a satisfactory combing effect. Thus, when fibers are guided from a position where they are held between the presser and the feed roller to a raking point at the combing roller, they are deflected to the extent that the extracting action on the fibers is obstructed and damage or breakage occurs to the fibers, bringing about the undesirable result that the spun yarn has a considerably degraded external appearance and greatly decreased strength. This disadvantage may be avoided by somewhat decreasing the pressure of the presser, but such countermeasure results in an ineffective extraction phenomenon in which fibers are extracted in groups from the pressing region, thereby detracting from the uniformity of the yarn.

With the various problems described above taken into account, it is an object of the present invention to provide a method of feeding a sliver into a combing section in an open end spinning machine especially suitable for the combing of artificial or synthetic fibers having staple lengths greater than that of cotton and characterized in that a raking point is established substantially at a point of contact between said combing roller and a tangent common to said feed roller and combing roller, a sliver is released from the peripheral surface of the feed roller in such a manner that the angle of transfer of the sliver to said raking point is 0° to 15° with said common tangent taken as the reference line and that the front end of a presser is extended in the direction of transfer of the sliver to support the lower side of the sliver and in this condition the sliver is guided to a place close to the periphery of the combing roller.

Another object of the present invention is to provide a presser for use in carrying out the method above described, comprising a nip surface for a sliver consisting of a curved surface having a radius which is a little larger than that of a feed roller, a flat fiber guide surface extending from said nip surface toward a combing roller and extending substantially in parallel with a tangent common to said feed roller and combing roller, and guide walls provided on the opposite sides of said fiber guide surface for limiting the spreading of the fiber bundle passing over said guide surface.

The present invention will be better understood from the following description taken in connection with the accompanying drawings in which.

Figure 1:
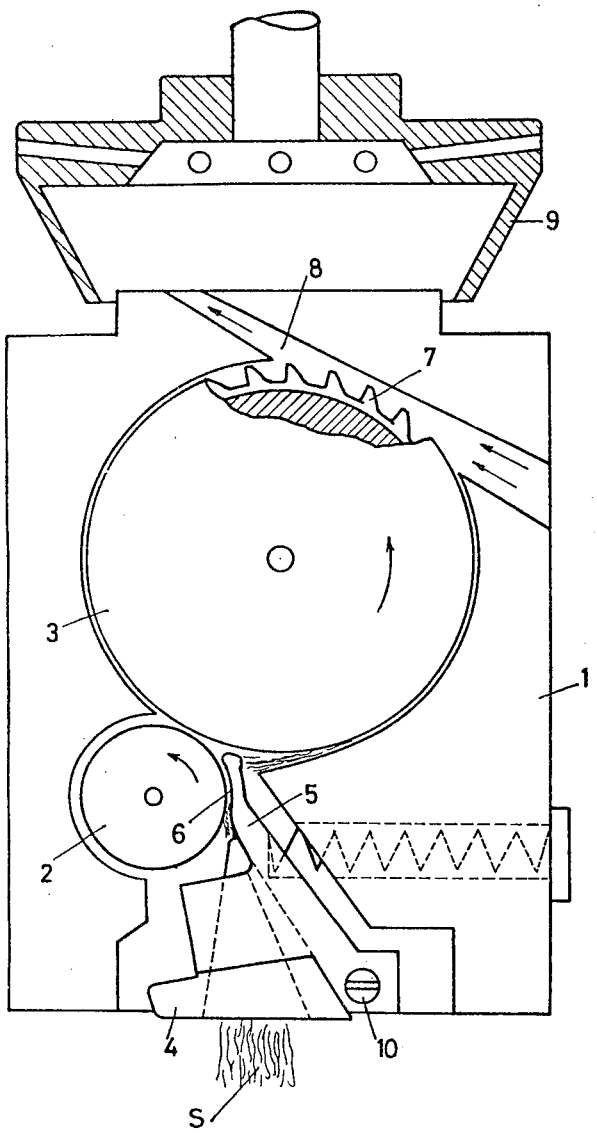
FIG. 1 PRIOR ART
FIG. 1 is a schematic plan view showing a combing section of a conventional open end spinning machine.

With reference now to the drawing and more particularly FIG. 1 thereof, there is illustrated a combing section of a conventional open end spinning machine.

The reference numeral 1 designates a main body in which a feed roller 2 and a combing roller 3 are arranged side by side on parallel axes. A sliver S introduced through a condenser 4 is held between a nip surface 6 of a presser 5 and the feed roller 2 and is transferred to the periphery of the combing roller 3 by the rotation of the feed roller 2. The sliver S is raked and combed by a saw-tooth wire 7 on the combing roller 3 and then transferred to a rotary spinning chamber 9 through a channel 8.

In such a conventional arrangement, the sliver S is deflected or bent at a substantial angle when it leaves the presser 5. Therefore, if the staple length is so long that the tail end portion of a fiber is still held between the presser 5 and the feed roller 2 while its leading end portion is subjected to the combing action of the saw-teeth wire 7, the fiber is held against the drawing force exerted on it by the combing action of the combing roller 3 not only by the nip pressure exerted on the sliver by the presser 5 but also by the friction between the sliver and the presser at the place where the sliver is substantially bent. Thus, as described hereinbefore, the extracting action on the fiber is obstructed by the increased resistance and damage or breakage occurs to the fibers.

Figure 2:
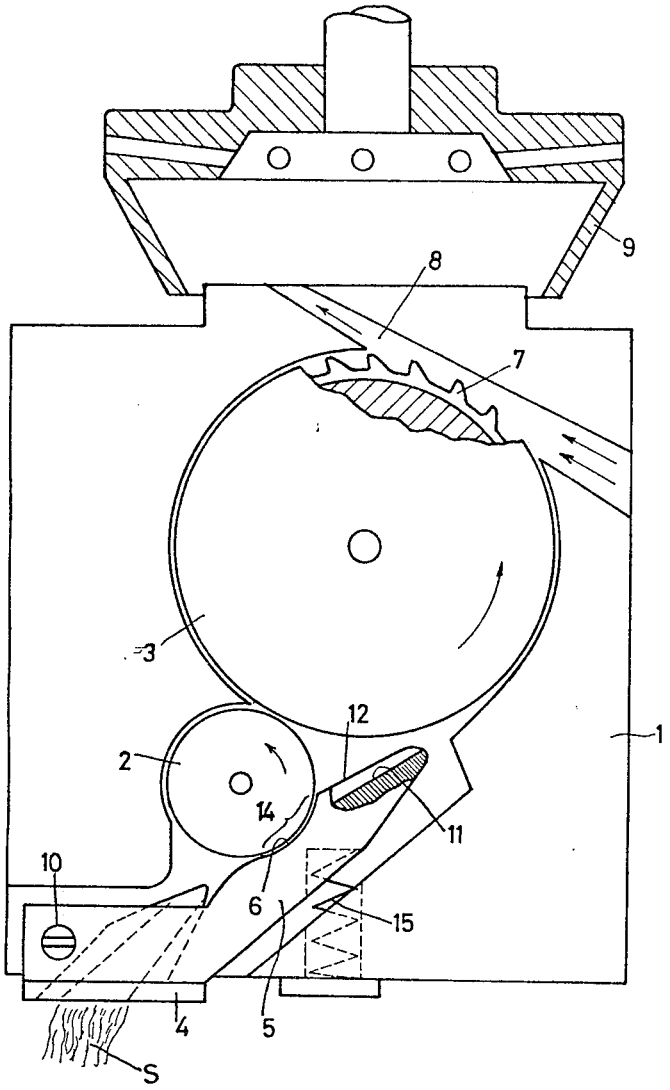
FIG. 2 is a schematic plan view showing a combing section of an open end spinning machine employing a method according to the present invention.
Figure 3:
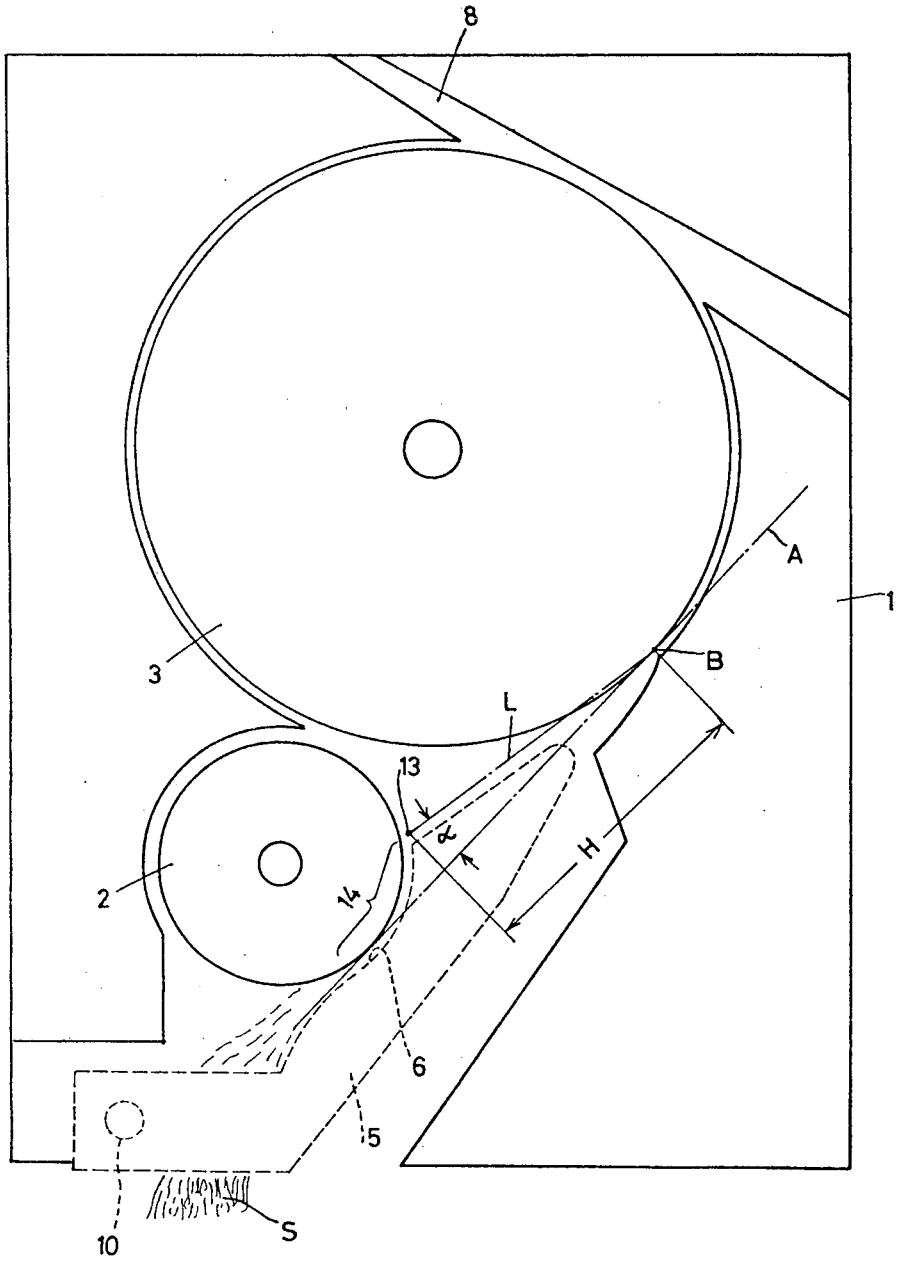
FIG. 3 is an enlarged view of a major portion of FIG. 2.

Referring now to FIGS. 2 and 3 of the drawings, there is illustrated an embodiment of the present invention.

As shown in FIGS. 2 and 3, according to the present invention, a raking point B is established substantially at a the point of contact between the combing roller 3 and a tangent A common to the feed roller 2 and the combing roller 3. The sliver S is released from the peripheral surface of the feed roller 2 in such a manner that the angle of transfer $\alpha$ of the sliver to said raking point B is 0° to 15° to said common tangent A taken as the reference line. This angle is formed at the feed roller side of said common tangent A since the sliver S is released from said feed roller at a point located at the feed roller side of the common tangent A. The front end of a presser 5 is extended in the direction of transfer of the sliver S to support the lower side of the sliver S and to guide it to a place close to the peripheral surface of the combing roller 2.

Described more concretely, the feed roller 2 and the combing roller 3 are rotatably arranged side by side on parallel axes in a recess in the main body 1 and the presser 5, which is swingably attached to the main body 1 by a pin 10, is urged toward the feed roller 2 by the action of a spring 15 to hold the sliver S between the nip surface 6 thereof and the feed roller 2. In the present invention, the presser 5 is pivotally mounted on the main body 1 adjacent a line passing through the axes of the combing roller 3 and feed roller 2 and the sliver S fed in through a condenser 4 is delivered by the rotation of the feed roller 2 while being held between the feed roller 2 and said nip surface 6 and, passes over the presser 5 to the raking point B at the combing roller 3, where it is subjected to the combing action. As shown in FIG. 3, the point of contact between the combing roller 3 and a tangent A common to the feed roller 2 and the combing roller 3 is taken substantially as the raking point B and the sliver S is delivered along said common tangent A. That is, it is so arranged that the sliver S freed from clamp between the nip surface 6 of the presser 5 and the feed roller 2 is advanced toward the raking point B with the degree of bending thereof at the release point 13 minimized. Further, the distance H between the raking point B and the release point 13 is made slightly less than the average staple length of the sliver S and the sliver S being transferred is supported by the front end of the presser 5 from the lower side of the sliver, whereby the fibers are subjected to the action of the saw-teeth 7 of the combing roller 3 while the fibers are in a tensioned condition, so that they are smoothly combed and transferred as separate single fibers and along with air they are conveyed to the spinning chamber 9 through a channel 8.

Figure 4:
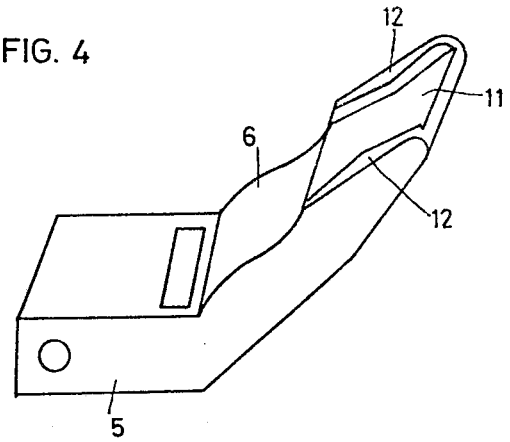
FIG. 4 is a perspective view of a presser according to the present invention.
Figure 5:
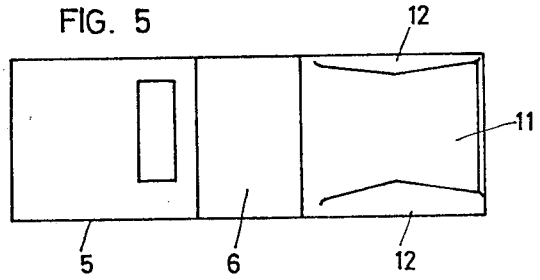
FIG. 5 is a top plan view of FIG. 4.

The presser according to the present invention, as shown in FIGS. 4 and 5, comprises a nip surface 6 for a sliver, said nip surface consisting of a curved surface having a radius which is a little larger than that of the feed roller 2, a flat fiber guide surface 11 extending from said nip surface 6 toward the combing roller 3 and extending substantially in parallel with the tangent A common to said feed roller 2 and the combing 3, and guide walls 12 provided on the opposite sides of said fiber guide surface 11 for limiting the spreading of the fiber bundle passing on said guide surface 11.

The length of said guide surface 11 is sufficiently large to transfer the fiber bundle as delivered from the feed roller 2 to a place close to the periphery of the combing roller 3, and is preferably at least one half the average fiber length of the sliver S being fed. Furthermore, the guide walls 12 are preferably shaped, as best seen in FIG. 5, to narrow the width of the fiber bundle which has been spread in the nip region to a width smaller than the effective width of the combing roller 3 to enable the saw-teeth wire 7 of the combing roller 3 to act throughout the width of the fiber bundle to eliminate the floating fibers.

If the saw-teeth wire 7 is spirally wound on the peripheral surface of the combing roller 3, there is a tendency that the fibers are urged toward either side of the presser 5 depending on the winding direction of the saw-teeth wire 7. In such instance, it is preferable to make the width of one guide wall 12 toward which the fibers are urged larger than the width of the other guide wall 12 to compensate for the deflection of the fiber. For instance, if the saw-teeth wire 7 is wound as a left-hand screw, it is preferable to make the width of the lower guide wall 12 as viewed in FIG. 5 larger than that of the upper guide wall 12.

Figure 6:
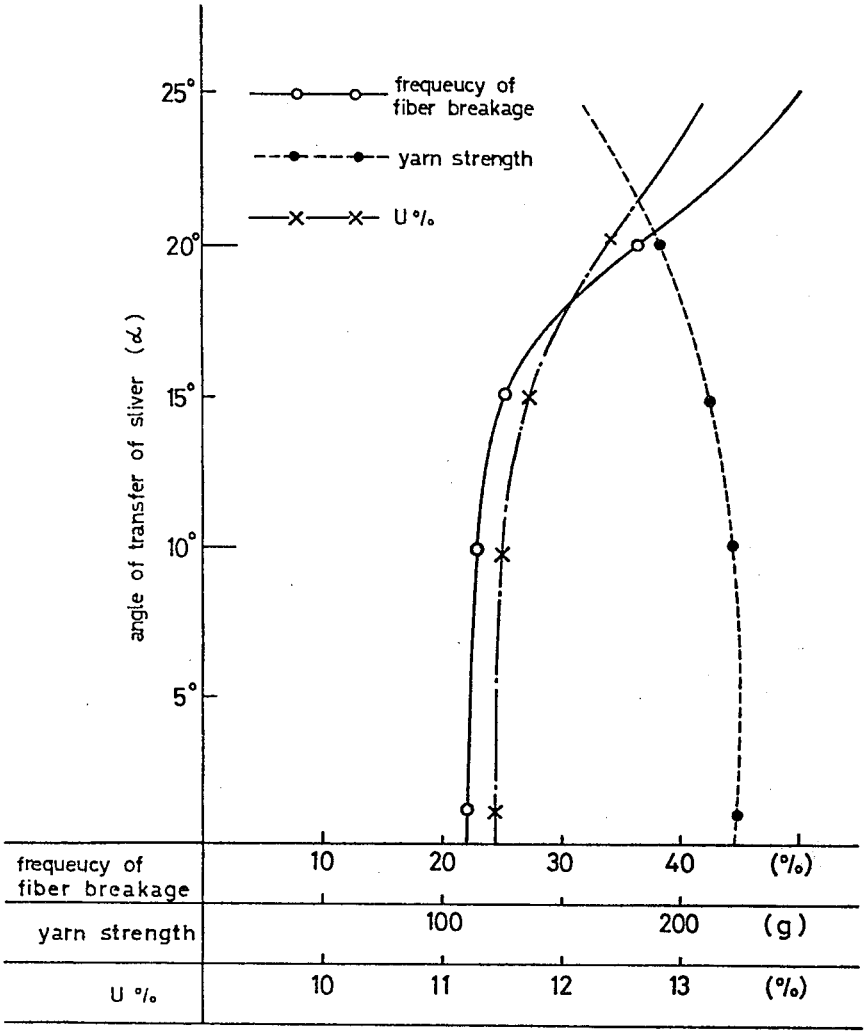
FIG. 6 is a graph showing how the quality of spun yarn is effected by the angle of transfer of sliver.

An experiment will now be described. The angle of transfer $\alpha$ of the sliver S to the raking point B which is included between a straight line L connecting the raking point B and said point of release 13 and said common tangent A was changed in the range of 0° to 25° with the common tangent A taken as the fixed reference line and viscose fiber having a staple length of 5.1 mm. was used to spin a 30-count yarn. As a result, it has been found that as shown in FIG. 6, in a range where said angle of transfer $\alpha$ is between 0° and 15°, the frequency of breakage of fibers is low, providing a satisfactory yarn strength and decreased unevenness of yarn, but that as the angle of transfer $\alpha$ exceeds 15°, the frequency of breakage of fibers is increased, providing a decreased yarn strength and increased unevenness of yarn. The conventional arrangement shown in FIG. 1 has been found unfit for the combing of textile materials having a staple length of 51 mm. or above.

As has been described so far, according to the present invention, the sliver S released from the nip region 14 is transferred to the raking point B with almost no bending thereof involved as described above. Therefore, the fibers which have been subjected to the raking and combing actions at the raking point B are successively and smoothly extracted without unevenness, with the frequency of breakage of fibers is greatly increased, so that a spun yarn of good quality with increased strength can be obtained.

Moreover, it has been made possible to spin artificial or synthetic fiber slivers having a staple length of 51 mm. or above by small-scale remodeling of the conventional combing section. Thus, the present invention is useful in widening the variety of yarns spun by this type of open end machines.

What is claimed is:

1. A method of feeding a sliver into a combing section in an open end spinning machine including a feed roller and a combing roller which are arranged side by side on parallel axes within a main body, comprising the steps of releasing a pressed sliver from the peripheral surface of the feed roller in such a manner that the angle of transfer of sliver to a raking point which is substantially at a point of contact between said combing roller and a tangent common to said feed roller and combing roller and lying on the same side of said parallel axes is 0° to 15° with said common tangent taken as the reference line, and supporting the lower side of the sliver by extending the front end of a presser in the direction of transfer of the sliver and guiding the sliver to a place close to the periphery of the combing roller with said presser.

2. An apparatus for feeding a sliver into a combing section in an open end spinning machine including a feed roller and a combing roller which are arranged side by side on parallel axes within a main body, said apparatus comprising a presser having a nip surface for a sliver consisting of a curved surface of a radius which is a little larger than that of the feed roller, a flat fiber guide surface extending from said nip surface toward the combing roller substantially linearly relative to the nip surface to guide the sliver fed out from the feed roller to the combing roller, and guide walls extending along the fiber guide surface for limiting spreading of the fiber bundle passing along the guide surface, the guide surface of the presser being oriented to transfer the fibers to a raking point substantially at a point of contact between the combing roller and a tangent common to the feed roller and the combing roller and lying on the same side of said parallel axes, and said guide surface being at an angle of 0° to 15° with said common tangent taken as the reference line.

* * * * *